United States Patent [19]

DeJaynes

[11] Patent Number: 5,054,699

[45] Date of Patent: Oct. 8, 1991

[54] RIBBON CURLING AND SHREDDING DEVICE

[76] Inventor: Arnold M. DeJaynes, R.R. #1, Box 168, New London, Iowa 52645

[21] Appl. No.: 454,429

[22] Filed: Dec. 21, 1989

Related U.S. Application Data

[63] Continuation-in-part of Ser. No. 204,787, Jun. 10, 1988.

[51] Int. Cl.[5] ..... B26B 13/00

[52] U.S. Cl. ..... 241/101.2; 241/168; 241/274; D8/98; 30/279.2; 30/304

[58] Field of Search ..... 241/101.2, 168, 274; D8/98; 30/279.2, 304

[56] References Cited

U.S. PATENT DOCUMENTS

| | | | |
|---|---|---|---|
| 3,883,953 | 5/1975 | Saullo et al. | 30/304 |
| 4,798,116 | 1/1989 | Silver et al. | 241/168 X |
| 4,869,435 | 9/1989 | Pistorius et al. | 241/169.1 X |

*Primary Examiner*—Frank T. Yost
*Assistant Examiner*—Frances Chin
*Attorney, Agent, or Firm*—Zarley, McKee, Thomte, Voorhees & Sease

[57] ABSTRACT

The ribbon curling and shredding device of this invention utilizes an upper base member vertically slidably mounted on a lower base member by means of two pairs of posts which extend upwardly from one end of the lower base member and the central portion of the lower base member. These posts slidably extend through aligned apertures in the upper base member. Enlarged head portions on the post prevent the complete detachment of the two base members. Compression spring members embrace each of the posts to yieldably hold the two base members in spaced separation. A plurality of sharp needles extend downwardly from the lower side of the upper base member in the open space that exists between the two base members opposite the four posts. A pad member made of wood or the like appears in the upper surface of the lower base member immediately below the protruding needles. A ribbon curling means comprised of a projection on the upper surface of the upper base member and including an arcuate concave portion terminating in a pair of straight sides.

9 Claims, 2 Drawing Sheets

RIBBON CURLING AND SHREDDING DEVICE

This application is a continuation-in-part of copending application Ser. No. D-204,787 filed June 10, 1988.

BACKGROUND OF THE INVENTION

It is commonplace for decorative ribbon to be used on gift packaging and the like. The ribbon is used to bind the packages and is used in the creation of bows used on the packaging. It is commonplace to strip the ribbon into a plurality of individual strips, usually after the ribbon has been pulled over a sharp edge of a knife or the like to create a helical or curled configuration in the ribbon.

Ribbon shredding devices comprising upper and lower base members resiliently spaced apart with a plurality of needles in one of the base portions have long been in use. The ribbon is shredded by compressing the two base portions together wherein the needles penetrate the ribbon. The ribbon is then pulled longitudinally through the needles to create the shredding phenomenon.

Several shortcomings exist in conventional ribbon shredding devices. First of all, the base members are usually supported on four posts with springs thereon. The ribbon to be shredded must be threaded endwise between the two base members and between the various posts to encounter the needles which perform the shredding function. This lengthwise threading of the ribbon through the device is sometimes inconvenient.

In addition, conventional ribbon shredders do not have any device thereon for also curling the ribbon. Thus, the ribbon must be first curled with a knife or the like, and then separately threaded through the ribbon shredding device.

Conventional ribbon shredding devices normally have the protruding needles on the upper base member nesting in an elongated V-shaped notch or the like in the lower base member to permit the needles to penetrate the ribbon being drawn over the upper surface of the lower base member and the V-shaped notch therein. The ends of the needles ultimately become worn after long use, and they are almost never of the same precise length even upon fabrication. As a result, some needles are easily broken as the ribbon is drawn there-through, particularly those needles which are shorter in length and which are not supported at their lower ends during the shredding operation.

Therefore, it is a principal object of this invention to provide a ribbon shredding device wherein the shredding needles are not located between the supporting posts for the upper and lower base members, but are located in an outer open portion between the base members to permit the ribbon to be laterally inserted between the base members underneath the shredding needles.

A further object of this invention is to provide a ribbon shredding device which also has a ribbon curling device thereon so that the ribbon can be first curled and then immediately passed through the ribbon shredding mechanism without having to be handled twice in two separate independent operations.

A further object of this invention is to provide a ribbon curling and shredding device which will permit the shredding needles to be supported at their lower ends during the shredding operation to prevent needle breakage.

These and other objects will be apparent to those skilled in the art.

SUMMARY OF THE INVENTION

The ribbon curling and shredding device of this invention utilizes an upper base member vertically slidably mounted on a lower base member by means of two pairs of posts which extend upwardly from one end of the lower base member and the central portion of the lower base member. These posts slidably extend through aligned apertures in the upper base member. Enlarged head portions on the post prevent the complete detachment of the two base members. Compression spring members embrace each of the posts to yieldably hold the two base members in spaced separation.

A plurality of sharp needles extend downwardly from the lower side of the upper base member in the open space that exists between the two base members opposite the four posts. A pad member made of wood or the like appears in the upper surface of the lower base member immediately below the protruding needles.

A ribbon curling means is comprised of a projection on the upper surface of the upper base member and including an arcuate concave portion terminating in a pair of straight sides. The ribbon is first curled by running it longitudinally over the ribbon curling device while at the same time exerting thumb or finger pressure on top of the ribbon in the concave-shaped area. The curled ribbon is then inserted laterally into the open end of the device. The upper and lower base members are then moved towards each other so that the needles penetrate the ribbon and slightly penetrate the pad underneath the needles. The ribbon is then drawn longitudinally through the needles to effect the shredding operation. The springs on the end of the base members should be stronger than the springs on the centrally located posts. This facilitates maintaining the upper and lower members in parallel condition as they are compressed together.

DESCRIPTION OF THE PREFERRED EMBODIMENT

Figure 1:
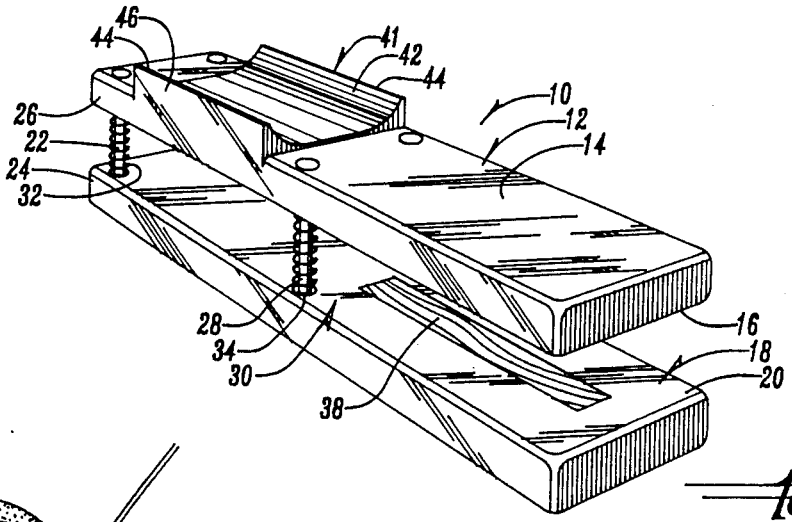
FIG. 1 is a perspective view of the ribbon curling and shredding device of this invention.

The numeral 10 designates the ribbon curling and shredding device of this invention comprising upper base member 12 which has an upper surface 14 and a lower surface 16. A lower base member 18 has an upper surface 20. A pair of posts 22 are secured to one end of lower base member 18 in any convenient fashion and extend vertically upwardly therefrom and terminate in enlarged heads 22A. Posts 22 are located adjacent end 24 of the lower base member 18. Post 22 extend upwardly through apertures (not shown) in the end 26 of the upper base member 12. The enlarged heads 22A of post 22 prevent the ultimate separation of the upper and lower base members.

A pair of second posts 28 with enlarged heads 28A extend upwardly from the mid point 30 of lower base member 18. The upper ends of posts 28 extend through suitable apertures in the mid portion of upper base member 12. The upper base member is adapted to slide vertically on the posts 22 and 28.

Springs 32 are mounted on post 22, and springs 34 of less compressive construction are mounted on post 28. It has been found that the combination of heavy springs on post 22 with the lighter springs on post 28 aids in maintaining the upper base portion 12 in parallel relation to lower base portion 18. The heavy springs 32 have a wire diameter of 0.022. The springs 34 have a wire diameter of 0.016.

Figure 8:
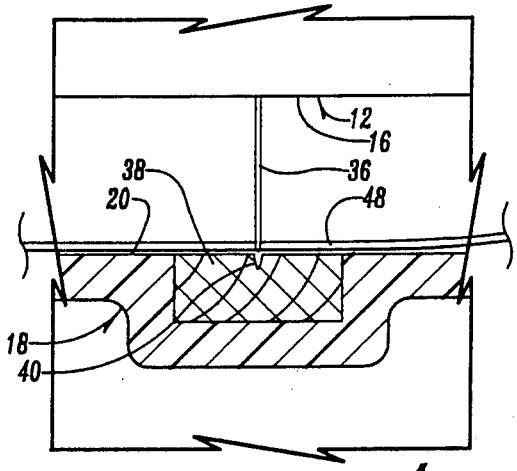
FIG. 8 is an enlarged scale sectional view similar to that of FIG. 6 but taken during the ribbon shredding operation.
Figure 7:
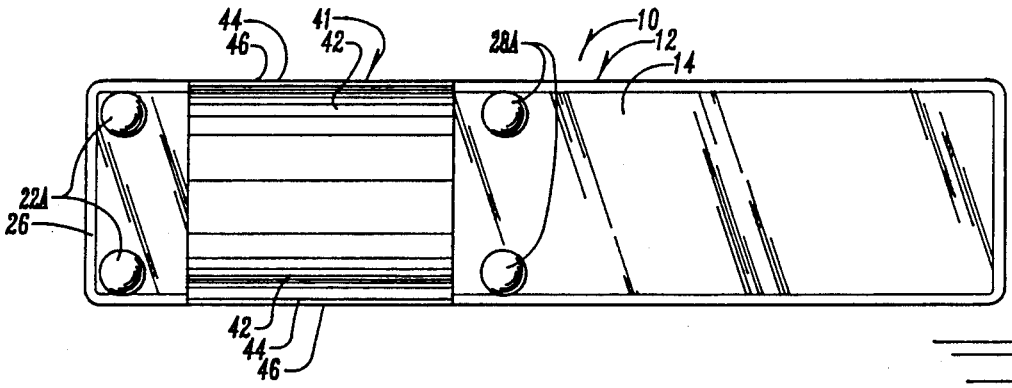
FIG. 7 is a top plan view of the device of FIG. 1.

A plurality of needles 36 are mounted by their upper ends to the lower surface 16 of upper base member 12. The lower sharpened ends of needles 36 do not extend completely to the upper surface of lower base member 18 when the device is in its dormant position of FIG. 1. An elongated pad 38 is mounted in the upper surface 20 of lower base member 18 and is positioned directly below the protruding needles 36. Pad element 38 is preferably comprised of wood or the like which will allow some penetration therein by the needles. A penetration aperture 40 in pad 38 is best shown in FIG. 8.

A ribbon curling projection 41 is formed as a part of the upper base member 12 and is comprised of arcuate concave surface 42 which has elongated straight edges 44, which in turn terminate in vertical sides 46.

Figure 3:
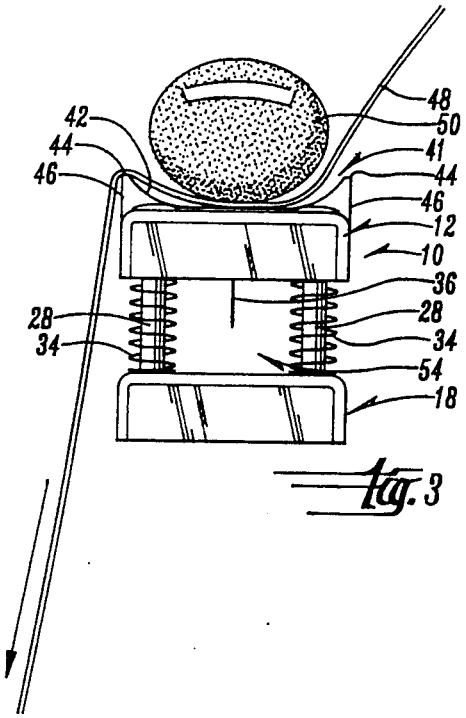
FIG. 3 is an end view of the device of FIG. 1 during the ribbon curling operation.
Figure 2:
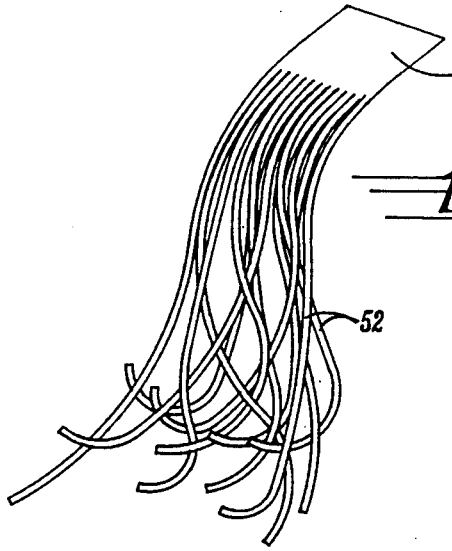
FIG. 2 is a perspective view of a shredded ribbon.

In operation, ribbon 48 is placed across concave surface 42 as shown in FIG. 3. The operator's thumb or finger 50 is exerted against the ribbon as shown in FIG. 3. The ribbon is then drawn in a downwardly direction over one of the straight edges 44 and adjacent one of the vertical sides 46 of projection 41. The pulling action shown by the arrow in FIG. 3 results in elongated tension on the ribbon. That, combined with the braking effect caused by the pressure of finger 50, causes the ribbon to curl when released.

Figure 5:
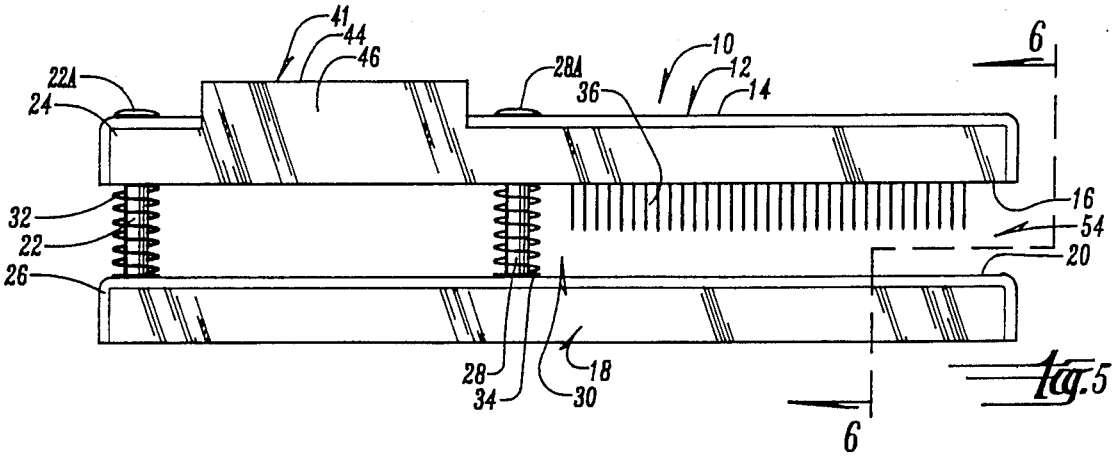
FIG. 5 is an enlarged scale side elevational view of the device of FIG. 1.
Figure 6:
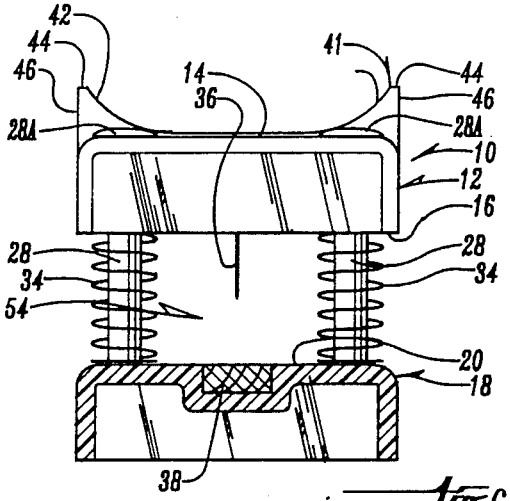
FIG. 6 is a partial sectional view taken on line 6—6 of FIG. 5.

The curled ribbon is then moved laterally between upper base members 12 and 18 with the upper and lower base members being in the expanded positions of FIGS. 1, 5 and 6. The open space 54 (FIG. 5) between the upper and lower base members facilitates the lateral insertion of the ribbon between the base members without interference by the posts 22 and 28.

Figure 4:
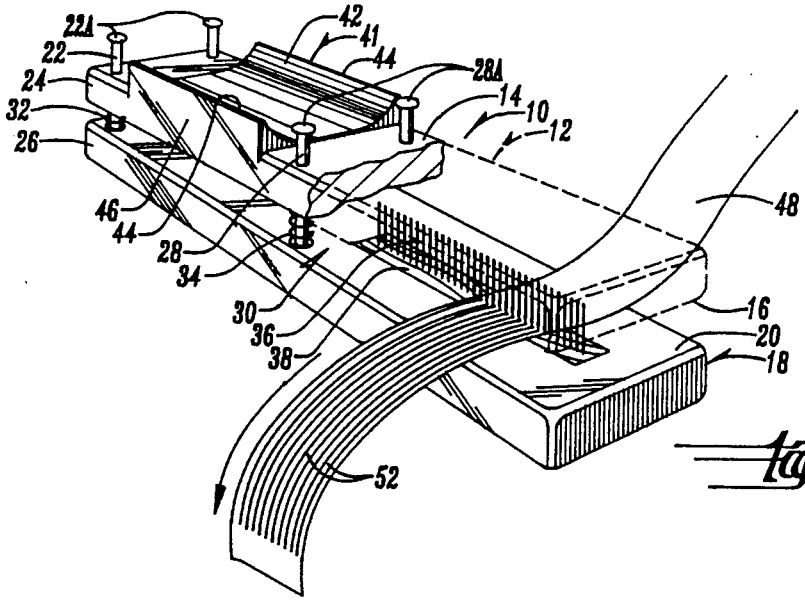
FIG. 4 is a partial sectional view similar to that of FIG. 1 but shows the device in its compressed form during the ribbon shredding operation.

Manual pressure is then used to compress the upper base member 12 downwardly towards the lower base member 18 as best shown in FIG. 4. This causes the needles 36 to penetrate the ribbon 48 as best shown in FIG. 8. It should be noted that the needles 46 penetrate not only the ribbon 48, but they also slightly penetrate the pad member 13 as indicated at 40. This means that the lower end of the needles are always secured against movement while the ribbon 48 is being pulled longitudinally through the needles as shown by the arrow in FIG. 4.

From the foregoing, it can be seen that this invention greatly facilitates the art of curling and shredding ribbons. The pad 38 greatly lengthens the life of the device by protecting the needles from being broken which is a result of the needles slightly penetrating the pad. It is therefore seen that the device of this invention will achieve at least its stated objects.

I claim:

1. A ribbon shredding device, comprising, an upper base portion having upper and lower surfaces, a lower base portion having an upper portion, said upper base portion and said lower base portion having first and second ends, resilient means resiliently connecting said upper and lower base portions and yieldingly holding them in vertical spaced relationship along their entire lengths, said resilient means comprising four vertical posts extending upwardly from said lower base portion with said upper base portion being slidably mounted on said four vertical posts, two of said posts being located adjacent said first ends of said upper and lower base portions, two of said posts being mounted centrally of said upper and lower base portions to leave the second end of said upper and lower base portions in spaced relationship to permit a length of ribbon to be moved into the space between said second ends by passing between said second ends, compression springs on said posts normally holding said upper and lower base portions in spaced apart relation, a plurality of downwardly extending needles having lower ends being secured to the lower surface of said upper base portion and extending downwardly toward said lower base portion so that when said base portions are yieldably moved towards each other, the lower ends of said needles will engage said lower base portion, said needles being positioned adjacent said second end of said upper base member whereby a length of ribbon can be laterally moved into said space between said second ends of said base portions in the area adjacent said needles without interference from said posts.

2. A ribbon curling and shredding device, comprising an upper base portion having upper and lower surfaces, a lower base portion having an upper portion, means resiliently connecting said upper and lower base portions and yieldably holding them in vertical spaced relationships, a plurality of downwardly extending needles having lower ends being secured to the lower surface of said upper base portion and extending downwardly toward said lower base portion so that when said base portions are yieldably moved towards each other, the lower ends of said needles will engage said lower base portion, and an elongated pad member adapted for slight penetration by the lower ends of said needles mounted on the upper surface of said lower member underneath the lower ends of said needles.

3. A ribbon curling and shredding device, comprising an upper base portion having upper and lower surfaces, a lower base portion having an upper portion, means resiliently connecting said upper and lower base portions and yieldably holding them in vertical spaced relationships, a plurality of downwardly extending needles having lower ends being secured to the lower surface of said upper base portion and extending downwardly toward said lower base portion so that when said base portions are yieldably moved towards each other, the lower ends of said needles will engage said lower base portion, said upper base portion being slidably mounted on four vertical posts extending upwardly from said lower base portion, two of said posts being located adjacent first ends of said base portions, and two of said posts being mounted centrally of said base portions, compression springs on said posts normally holding said base portions in spaced apart condition, said needles being positioned on a second end of said base portions opposite to said first ends, whereby a length of ribbon can be laterally moved into a space between said second ends of said base portions in the area adjacent said needles without interference from said posts, an elongated pad member mounted on the upper portion of said lower base portion underneath the lower ends of said needles and adapted for slight penetration by the lower ends of said needles.

4. The device of claim 3 wherein said pad member is a wood block.

5. A ribbon curling and shredding device, comprising an upper base portion having upper and lower surfaces, a lower base portion having an upper portion, means resiliently connecting said upper and lower base portions and yieldably holding them in vertical spaced relationships, a plurality of downwardly extending needles having lower ends being secured to the lower surface of said upper base portion and extending downwardly toward said lower base portion so that when said base portions are yieldably moved towards each other, the lower ends of said needles will engage said lower base portion, a ribbon curling means on said upper base portion comprising an arcuate shaped concave portion terminating in at least one straight edge whereby a length of ribbon can be longitudinally pulled across said arcuate concave portion and thence pulled at a sharp angle over said straight edge to curl said ribbon, and thence threaded between said upper and lower base portions with said base portions being compressed towards each other so that said needles will penetrate and shred said ribbon, and an elongated pad member mounted on the upper surface of said lower member underneath the lower ends of said needles and adapted for slight penetration by the lower ends of said needles.

6. The device of claim 5 wherein said upper base member is slidably mounted on four vertical posts extending upwardly from said lower base member, two of said posts being located adjacent a first end of said base members, and two of said posts being mounted centrally of said base members, compression springs on said post members normally holding said base member in spaced apart condition, with the springs on said posts adjacent said first end of said base members being less resilient than the springs on the posts located centrally on said base members.

7. The device of claim 5 wherein said pad member is a wood block.

8. The device of claim 6 wherein an elongated pad member adapted for slight penetration by the lower ends of said needles is mounted on the upper surface of said lower member underneath the lower ends of said needles.

9. The device of claim 8 wherein said pad member is a wood block.

* * * * *